US006450232B1

(12) United States Patent
Smythe, Jr.

(10) Patent No.: US 6,450,232 B1
(45) Date of Patent: Sep. 17, 2002

(54) DRYWALL FINISHING ROLLER AND EDGE FINISHER

(76) Inventor: Timothy D. Smythe, Jr., 4017 Northcliff, Bend, OR (US) 97701

( * ) Notice: Subject to any disclaimer, the term of this patent is extended or adjusted under 35 U.S.C. 154(b) by 0 days.

(21) Appl. No.: 09/543,482

(22) Filed: Apr. 6, 2000

(51) Int. Cl.[7] ..... B30B 31/00

(52) U.S. Cl. ..... 156/579; 156/574; 81/485

(58) Field of Search ..... 15/235.3, 235.4, 15/235.7, 235.8; 156/579, 580, 582, 530, 574, 577; 425/458, 460; 81/485; 29/243.58, 266

(56) References Cited

U.S. PATENT DOCUMENTS

| | | | | |
|---|---|---|---|---|
| 3,932,101 | A | 1/1976 | Johnson et al. | 425/458 |
| 4,230,441 | A | 10/1980 | Heronema | 425/87 |
| 4,451,223 | A | 5/1984 | Mower et al. | 425/458 |
| 4,516,868 | A | 5/1985 | Molnar | 401/5 |
| 4,907,955 | A | 3/1990 | Snipes | 425/87 |
| 5,069,610 | A | 12/1991 | Milburn | 425/87 |
| 5,143,264 | A | 9/1992 | MacMillan | 222/567 |
| 5,203,954 | A | 4/1993 | Moore | 156/574 |
| 5,338,128 | A | 8/1994 | Blanco | 403/206 |
| 5,368,461 | A | 11/1994 | Murphy | 428/87 |
| 5,467,497 | A | 11/1995 | Greene et al. | 15/235.8 |
| 5,544,384 | A | 8/1996 | Forselius et al. | 15/235.7 |
| 5,774,924 | A | 7/1998 | Beckham et al. | 15/235.7 |
| 5,814,351 | A | 9/1998 | Mower | 425/87 |
| 5,920,946 | A | 7/1999 | McCarten | 15/236.01 |

*Primary Examiner*—Richard Crispino
*Assistant Examiner*—Sing P Chan
(74) *Attorney, Agent, or Firm*—Clifford Kraft

(57) ABSTRACT

A drywall finishing system for inside and outside drywall corners including regular corners and bullnose corners. A special roller tool with a flexible frame and four rollers is used to press prefabricated drywall trim into place over a coating of drywall mud. Embodiments for inside and outside corners differ in that the rollers for inside corners are opposed and those for exterior corners are open, in both cases forming an angle of 84 to 87 degrees but able to flex from 84 degrees to over 97 degrees to match an corner angle. A special edge finisher mud box then allows the tapered edges of the trim pieces to be feathered and brought to a finished state. The mud box has several different front slots for coarse and final feathering.

15 Claims, 8 Drawing Sheets

DRYWALL FINISHING ROLLER AND EDGE FINISHER

This application is related to U.S. Provisional application 60/128,656 and hereby incorporates it by reference.

BACKGROUND

1. Field of the Invention

This invention relates generally to the field of drywall installation and more particularly to a new roller and edge finisher system that allows fast accurate installation of inside and outside regular corners and bull nose corners.

2. Description of Related Art

The use of gypsum drywall board in modern construction is well known. Manufactured drywall sheets are nailed to studs to form interior walls and ceilings. Before these sheets can be painted or textured, the joints must be taped and sealed with joint sealing compound (drywall mud). Taping (known as stringing) is a tedious process since first tape and mud must be dispensed with a tool known as a bazooka, then the worker rolls and glazes the tape while the mud is wet. As the tape strings out, it has a tendency to pull in the direction of motion.

Many seams are finished with a product known as flex bead. This is usually first attached over the seam by nailing and then coated with drywall mud. After the mud is dry, it is sanded and finished several times, and then painted or textured.

A new system of interior and exterior flex trim material has been invented that can be constructed from a laminate of paper-plastic-paper or paper-plastic that is finished as soon as it is installed. This material can be tapered or beveled so that its edges can be "killed" with a small amount of drywall mud and a wide blade knife, or other, tool. This leads to a finished seam or corner with the material blending or feathered into the drywall sheet. The finished seam or corner is ready to paint or texture as soon as the mud drys with little or no sanding.

Using this new technology can be made even easier and more accurate with the use of special roller tools that are perfectly adapted to press the inside or outside corner tightly into the mud. Also feathering and killing of the edges with this new technology can be automated with an automated edge finishing tool.

SUMMARY OF THE INVENTION

The present invention relates to a system of roller tools and an edge finisher that can be used with prefabricated drywall corners, both regular, and bull nose. The roller is equipped with wheels that are designed to match the taper of the surface of the prefabricated drywall corner. The body of the roller is flexible so that the device can match corners that are not square and corners that are not perfect 90 degree angles. The flexibility can be achieved from slots cut in the body between the wheels or along the body. The wheels are thus mounted on a relatively smaller portion of the body and hence can flex to different angles from less than 84 degrees to over 96 degrees. The edge finisher is a mud application box that can be used with any type of corner and is designed to finish the edges with no handwork.

The edge finisher has a box for drywall mud with a front door that unlocks and swings open allowing the tool to be loaded with drywall mud and cleaned after the job. The tool also has interchangeable doors with different size openings, one size for initial feathering and a different size for final feathering.

After mud has been applied to the corner, a prefabricated corner piece is pushed into place by hand. Then the roller invention is run along the interior or exterior seam. There are two embodiments of the roller, one for inside and one for outside corners. The optionally tapered wheels can match the taper of the corner piece, and the piece is pushed tightly against the seam by the force on the rollers. The piece is then ready for finishing by killing the edges. For any corner, one loads drywall mud into the edge finishing tool and runs it along the edge. The tool can be equipped with a set of wheels to make this process easier. The tool applies exactly the right amount of mud and exactly the right pressure to feather the corner. The process should be repeated twice with two different doors on the tool for initial feathering and final feathering. The major feature of the edge finisher is the ability to open the doors wide for mud loading and for cleaning.

BRIEF DESCRIPTION OF THE DRAWINGS

For a more complete understanding of this invention, reference should now be made to the embodiments illustrated in greater detail in the accompanying drawings and described below by way of examples of the invention.

It should be understood, of course, that the invention is not necessarily limited to the particular embodiments illustrated herein.

DESCRIPTION OF PREFERRED EMBODIMENTS

Figure 1:
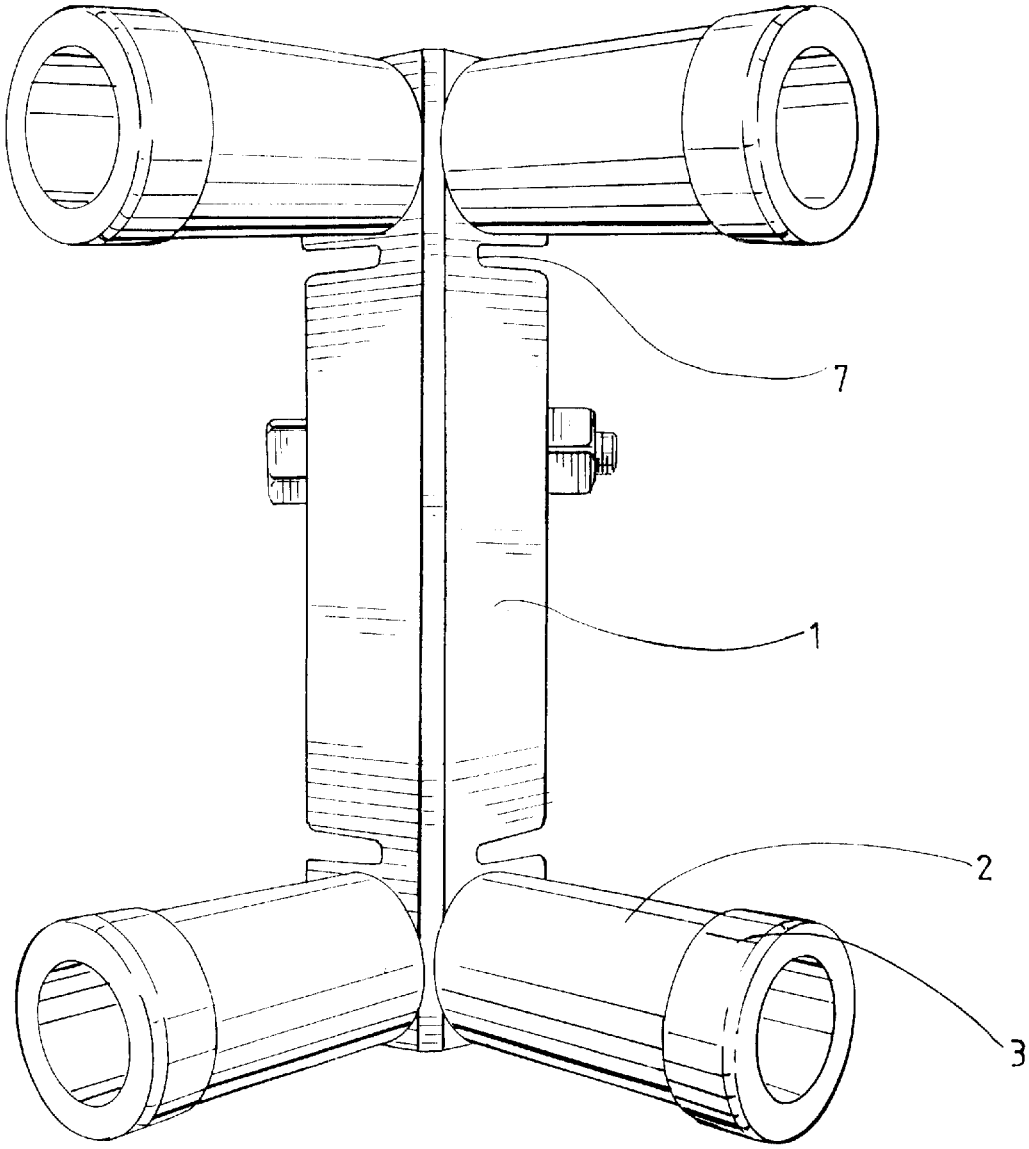
FIG. 1 shows a front-on view of the outside corner roller.

Turning to FIG. 1, a view of an embodiment of the exterior corner finishing roller can be seen. This is a front-on view looking at the tool from the drywall corner. A flexible frame 1 can be seen with four rollers 2 mounted facing the drywall. The rollers 2 are mounted in two pairs, each pair forming an angle of around 84–87 degrees. Slots 7 in the frame are cut so that the rollers 2 are mounted on small islands that can flex when the tool is pushed into the corner. In fact, the angle the rollers 2 make can open to greater than 96 degrees. This is important to the functioning of the invention since many corners are no exactly 90 degrees in real construction. It is a feature of the present invention that it squeeze the flexible corner tightly. The flex capability of the rollers 2 allows it to achieve this goal. Each roller also has an area of possibly larger diameter 3. This is to exactly fit a piece of preformed drywall corner. The larger diameter lies just beyond the end of the corner where the preformed corner meets the drywall. The roller 2 can be tapered or can have a raised portion in the vicinity of the edge 3. The slots 7 can be located on the ends of the frame 1 instead of on the sides as shown in FIG. 1.

Figure 2:
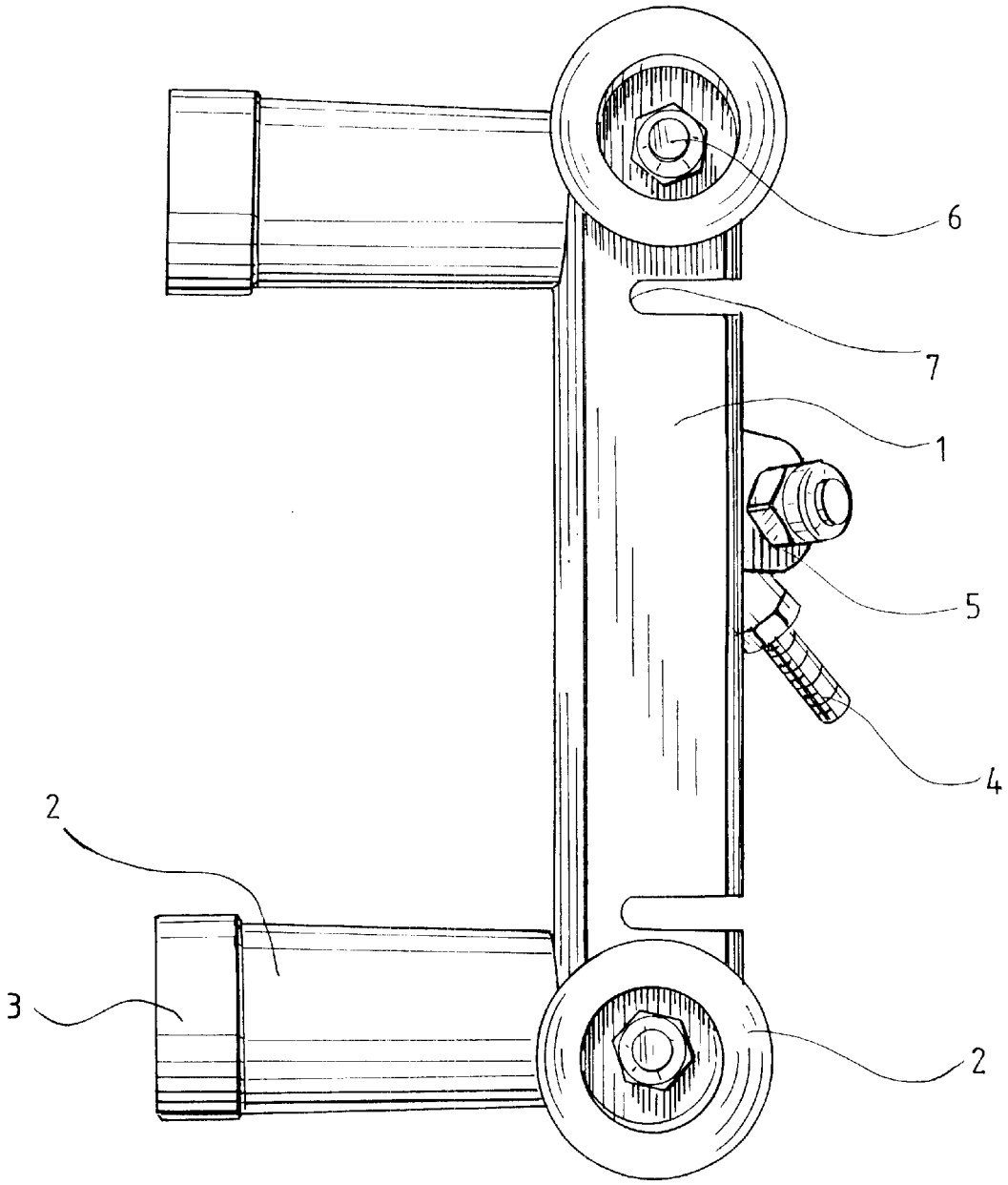
FIG. 2 shows a side view of the outside corner roller.

FIG. 2 shows a side view of the roller. Here it can be clearly seen the that rollers 2 are tapered with a greater diameter toward their tops (outer ends) 3 as toward their bases. The rollers 2 taper to exactly match the taper of the preformed drywall corner. Each roller 2 is attached to the frame 1 with a bolt and nut 6 that allows the roller to freely turn, but prevents it from slipping longitudinally. This bolt, which can be any fastening means including a specially designed rivet, screw or other fastening means, must not allow the roller 2 to move inward or outward along its shaft, but must allow it to freely rotate to finish the corner. On the back of the frame, a free hook or bolt 4 on a swivel 5 can be seen. This allows the roller tool to be attached to handles of various short or long lengths. The use of a handle allows the worker to move the roller tool along the length of the corner from top to bottom or bottom to top. The swivel 5 allows the frame 1 to always tightly pinch the corner. Also in FIG. 2, the slots 7 in the frame 1 can be seen. The frame 1 should be constructed of a flexible material. A strong plastic is preferable, however, metal will work. The rollers 2 may be made of plastic, synthetic material, wood, or metal. They must be solid and not compress. Also, since they suffer direct contact with the corner material, they must be durable and not easily wear.

Figure 3:
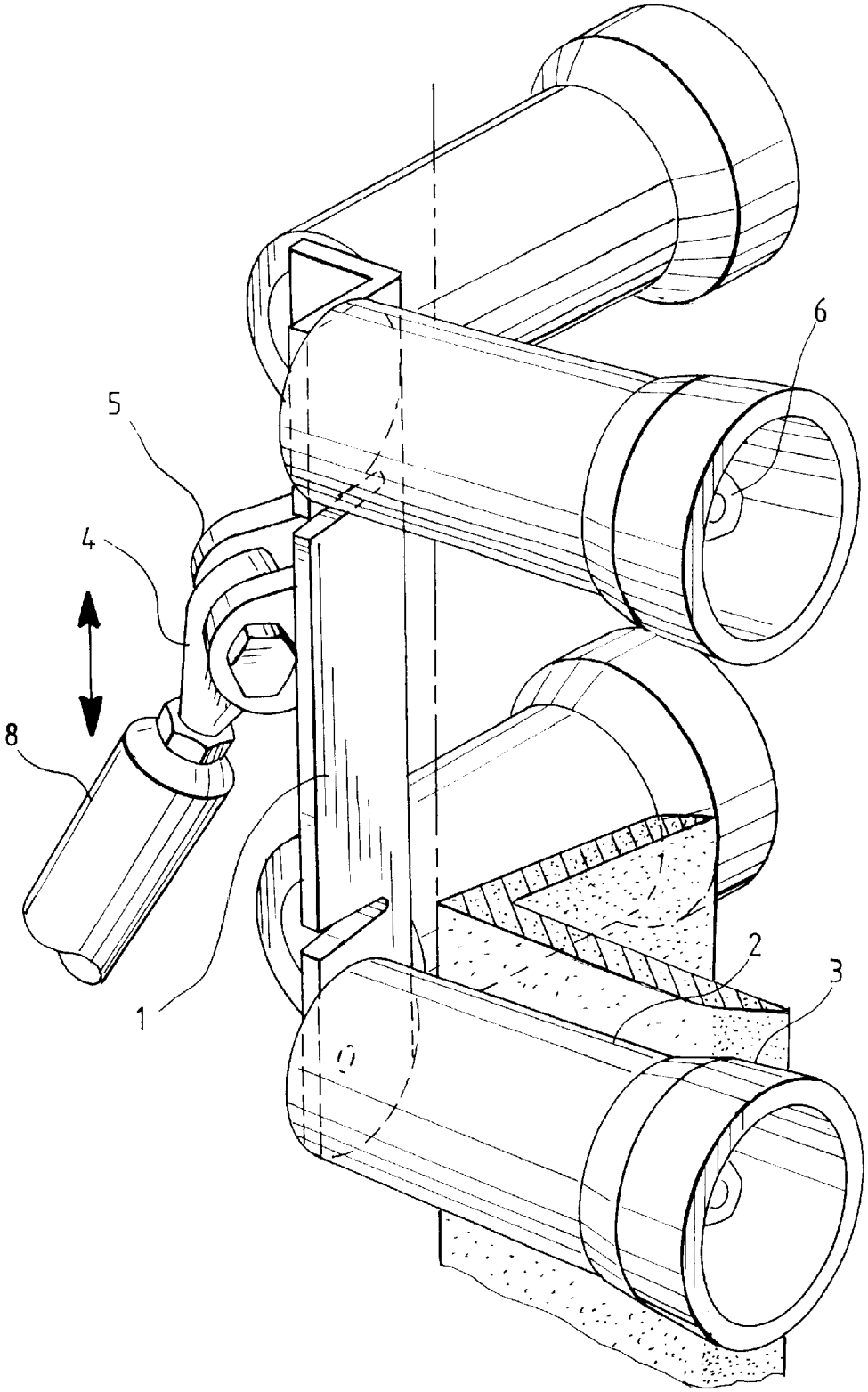
FIG. 3 shows an end perspective view of an embodiment of the outside corner roller.

FIG. 3 shows a perspective view of a possible embodiment of an exterior corner roller. The rollers 2 can be seen mounted to a frame 1 with bolts 6 or other fastening means. The outer part of each roller 3 is thickening than the inner part to allow matching the thickness of the preformed piece being installed. While the rollers 2 in FIG. 3 show a raised portion 3, tapering is also very acceptable. A hook 4 mounts into a swivel 5 which can be attached to a handle 8 to allow the tool to be run up and down a wall.

Figure 4:
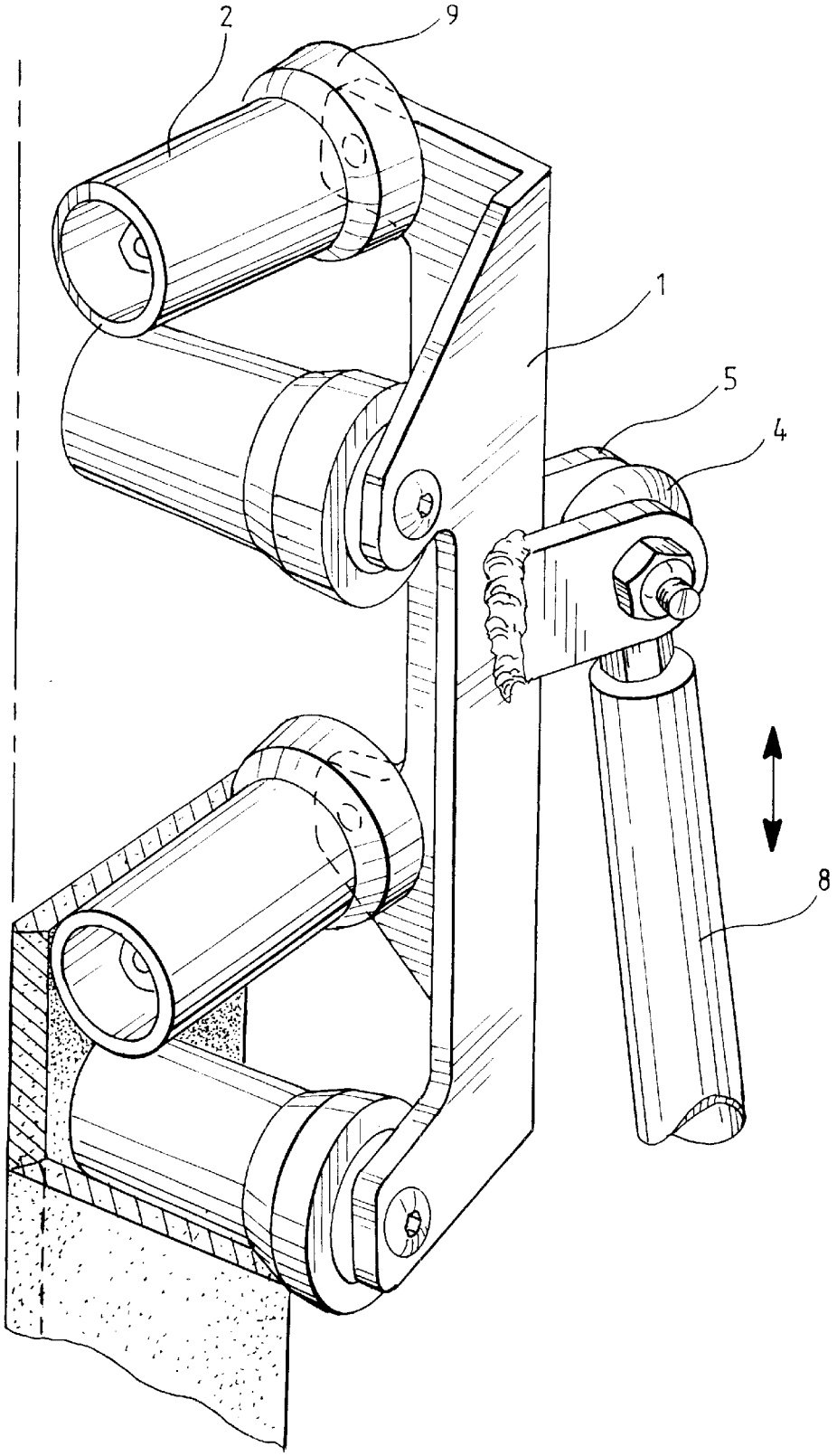
FIG. 4 shows a perspective view of an embodiment of the inside corner roller.

FIG. 4 shows a perspective view of an embodiment of the present invention designed for interior corners. Here the rollers 2 are mounted in an opposing manner with a thicker portion 9 on their inner ends. This thicker portion again matches the taper of the preformed drywall corner piece. These rollers 2 may also be tapered. In this embodiment, the four rollers are mounted in opposition, and are offset, so as to match the requirements of an inside corner. Again a strong but flexible frame 1 can be used with a hook 4 and swivel 5 attached to a handle 8.

Figure 5:
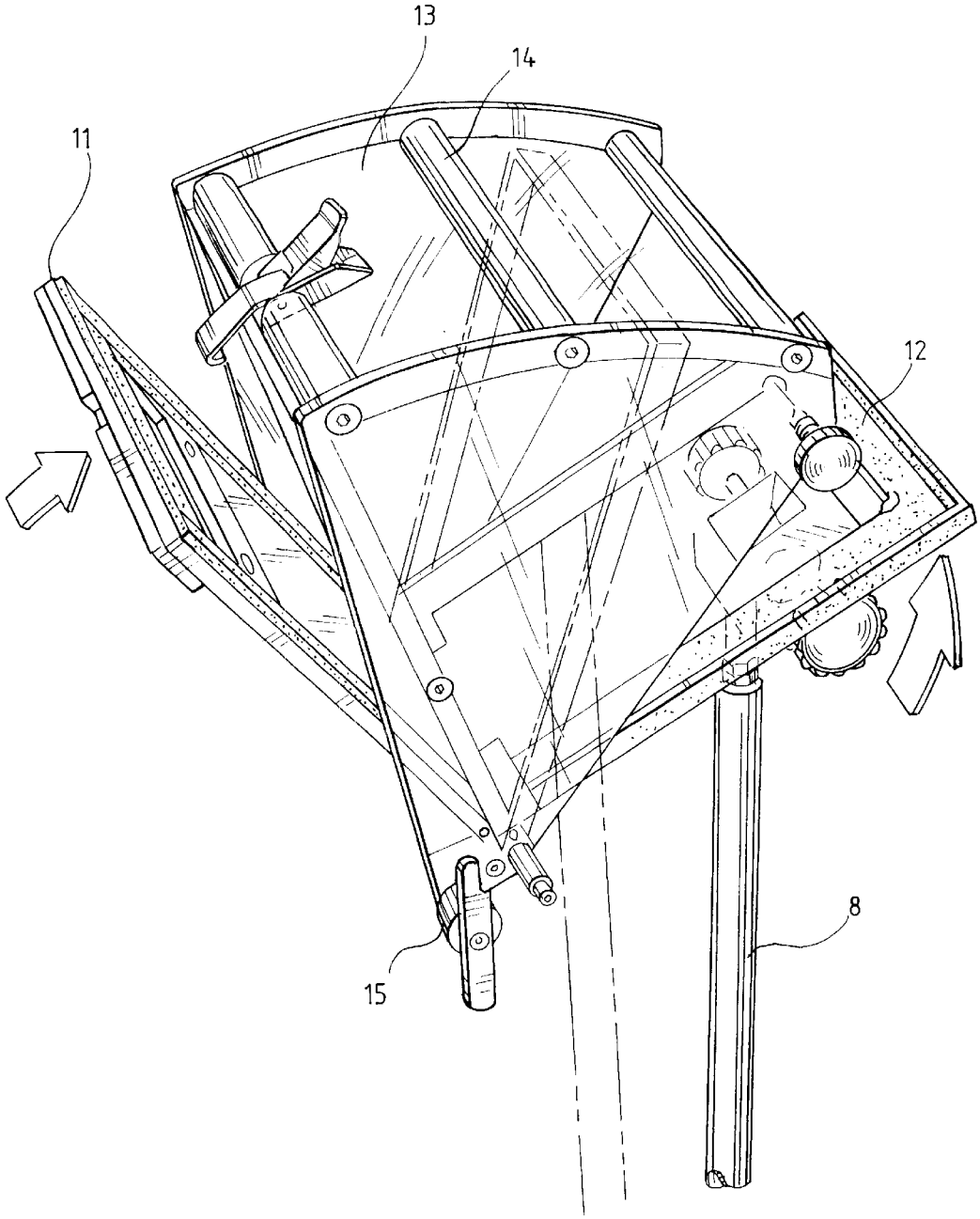
FIG. 5 shows a perspective view of the edge finisher.

FIG. 5 shows a perspective view of the edge finisher. The unit can be metal, plastic, or other durable material. Plastic or aluminum is a preferred choice. The finisher is roughly triangular shaped with two parallel sides 10. The back front form attached doors 11, 12 that open. FIG. 5 shows the front door 12 in the open position, and the rear door 11 in the closed position. In the front door 11 there is an elongated slot for dispensing drywall mud. The finisher also can have a set of wheels 15 that allow it to roll along the drywall/corner piece edge. The front door 11 can be removable and inter changeable with other doors with different sized slots. The sides of the unit 10 can be supported by cross ribs 14, and the last side 13 is made of a solid material that will not allow mud to escape. A handle 8 can attach to the back of the unit in order to run the unit up and down a drywall corner.

Figure 6:
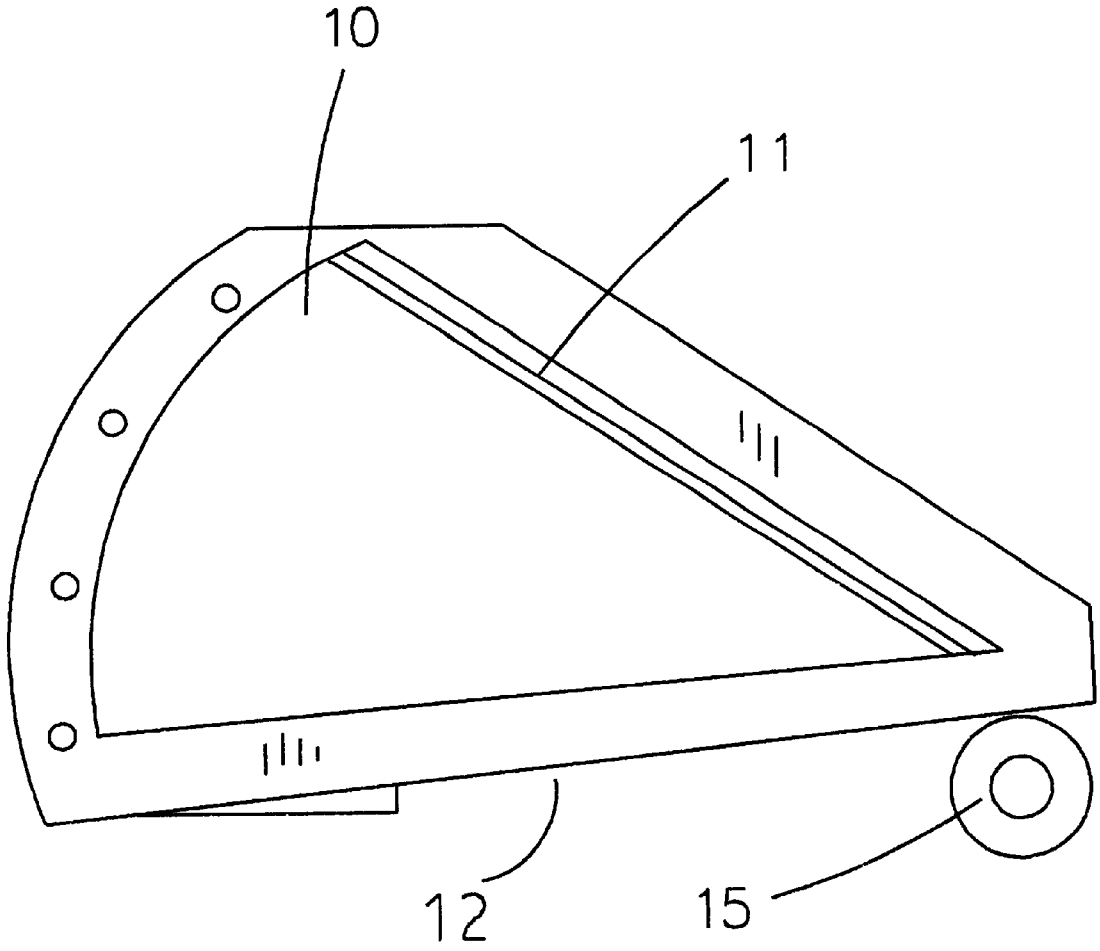
FIG. 6 shows a side view of the edge finisher with the doors closed.

FIG. 6 shows a view of the edge finisher with the doors 11 closed. The doors pivot, and when the entire unit is attached to a handle and used with pressure against the interface edge between the drywall and the preformed corner product, the pivoting action forces mud out the slot. The slot is equipped with a blade on its top. The front door 12 remains stationary in use since it is pressed against the drywall interface edge. The entire unit is run from top to bottom or from bottom to top of a corner to perfectly feather the edge. To fill the unit with mud, the doors 11, 12 are pivoted out of the way and the unit can be filled either by hand or with a mud pump known in the trade. One of the features of this invention is the ability to fill the unit by hand. Prior art units had to be filled with an expensive pump. Another feature of the present invention is the ability to swing both doors 11, 12 open to allow flushing and cleaning. FIG. 6 shows optional wheels 15 for rolling along the drywall seam.

Figure 7:
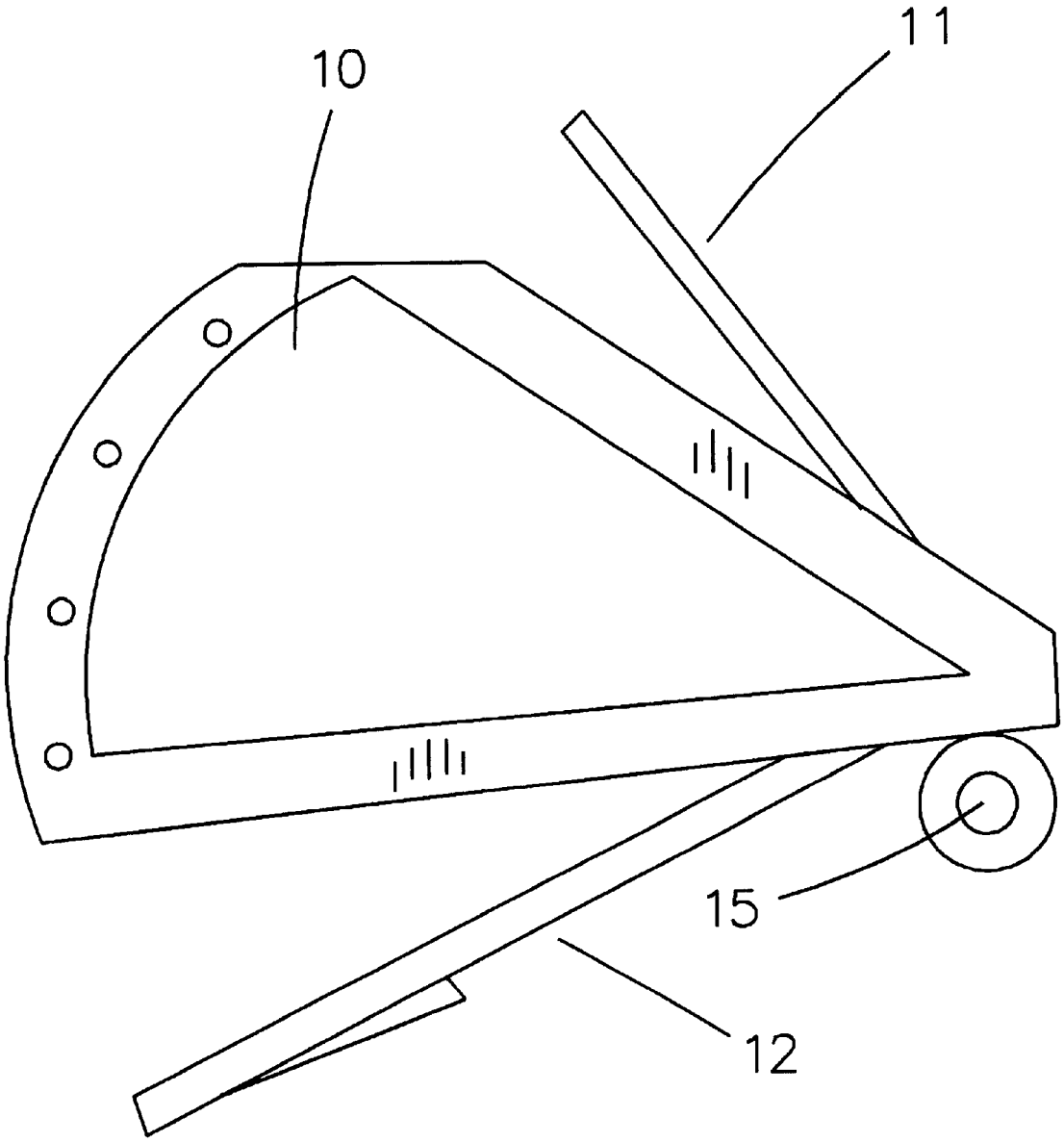
FIG. 7 shows a side view of the edge finisher with the doors open for filling or cleaning.

FIG. 7 shows the edge finisher unit with the doors 11, 12 in the open position for cleaning. Again the sides 10 and optional wheels 15 can be seen. For filling, it is only necessary to open one door, while for cleaning it is more convenient to open both doors.

Figure 8:
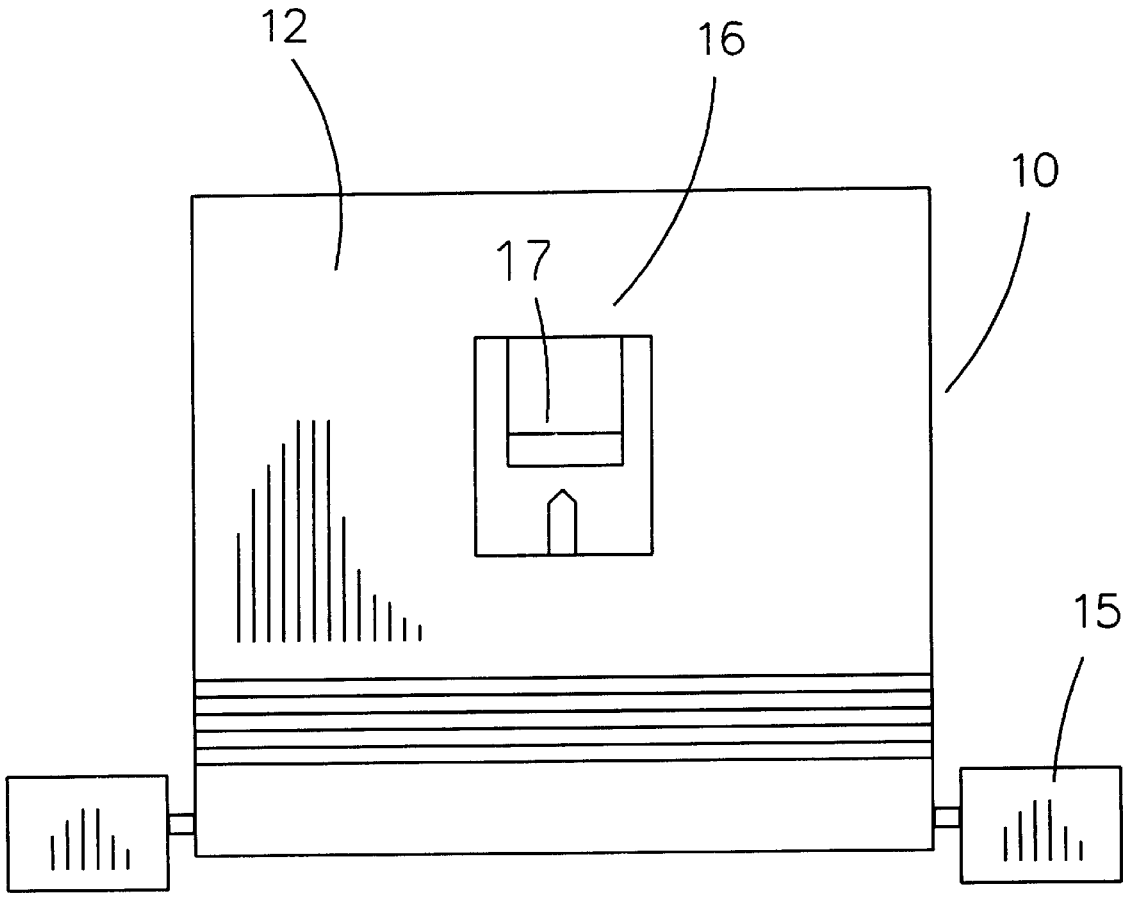
FIG. 8 shows a front view of the edge finisher.

FIG. 8 shows a front view of the edge finisher unit looking out from the drywall seam. The optional wheels 15 can be seen on each side of the unit as well as the side panels 10. The front door 12 is closed and a slot 16 can be seen where drywall mud is pushed out. The slot 15 contains a blade 16 which determines the amount of mud that can be pressed out. A larger slot is used for coarse feathering, while a smaller slot is used for final feathering. Several different blades can be interchanged on the unit.

It is to be understood that the above-described arrangements are merely illustrative of the application of the principles of the invention, and that other arrangements may be devised by those skilled in the art without departing from the spirit and scope of the invention.

I claim:

1. A drywall roller tool for finishing drywall corners comprising, in combination:

An elongated frame with two ends made of flexible material with a pair of rollers attached to each of said ends, each of said pair or rollers having a first and second roller, the first roller of one pair parallel to the first roller of the other pair, the second roller of one pair parallel to the second roller of the other pair, the first and second roller of each pair making an angle of between 84 and 96 degrees;

A plurality of slots in said frame said slots allowing the rollers in each pair to flex changing the angle between the first and second roller of each pair to match a drywall corner angle.

2. The drywall roller tool as in claim 1 wherein said rollers are tapered.

3. The drywall roller tool as in claim 2 wherein said tapered rollers have a smaller diameter near said elongated frame.

4. The drywall roller tool as in claim 1 wherein said elongated frame is plastic.

5. The drywall roller tool as in claim 1 further comprising a removable handle.

6. A drywall roller tool for finishing drywall corners comprising, in combination:

An elongated vertical frame with two ends made of flexible material with an L-shaped cross-section with a pair of rollers attached to each of said ends, each of said pair of rollers having a first and second roller, the first roller of one pair parallel to the first roller of the other pair, the second roller of one pair parallel to the second roller of the other pair, the first and second roller of each pair having a same vertical level on said vertical frame, the first and second roller of each pair making an angle of between around 84 and 96 degrees;

A plurality of slots in said vertical frame, said slots allowing the rollers in each pair to flex changing the angle between the first and second roller of each pair to match a drywall corner angle.

7. The drywall roller tool as in claim 6 wherein said rollers are tapered.

8. The drywall roller tool as in claim 7 wherein said tapered rollers have a smaller diameter near said elongated frame.

9. The drywall roller tool as in claim 6 wherein said elongated frame is plastic.

10. The drywall roller tool as in claim 6, further comprising a removable handle.

11. A drywall roller tool for finishing drywall corners comprising, in combination:

an elongated vertical frame with two ends made of flexible material with an L-shaped cross-section, said vertical frame having a left half and a right half;

a pair of rollers attached to each of the ends of said vertical frame, each of said pair of rollers having a first and second roller, the first roller of one pair parallel to the first roller of the other pair, the second roller of one pair parallel to the second roller of the other pair;

said first roller of each pair mounted above said second roller of each pair, said first roller of each pair mounted on said left half of said vertical frame and extending in a right direction, said second roller of each pair mounted on said right half of said vertical frame and extending in a left direction, the first and second roller of each pair making an angle of between around 84 and 96 degrees;

A plurality of slots in said frame, said slots allowing the rollers in each pair to flex changing the angle between the first and second roller of each pair to match a drywall corner angle.

12. The drywall roller tool as in claim 11 wherein said rollers are tapered.

13. The drywall roller tool as in claim 12 wherein said tapered rollers have a smaller diameter near said elongated frame.

14. The drywall roller tool as in claim 11 wherein said elongated frame is plastic.

15. The drywall roller tool as in claim 11, further comprising a removable handle.

* * * * *